US006437757B1

(12) United States Patent
Butler

(10) Patent No.: US 6,437,757 B1
(45) Date of Patent: Aug. 20, 2002

(54) LOW PROFILE ANTENNA RADOME ELEMENT WITH RIB REINFORCEMENTS

(75) Inventor: Jeffrey T. Butler, Candor, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/759,851

(22) Filed: Jan. 12, 2001

(51) Int. Cl.[7] ..... H01Q 1/36; H01Q 1/42
(52) U.S. Cl. ..... 343/872; 343/895
(58) Field of Search ..... 343/895, 872, 343/873; H01Q 1/36, 1/40

(56) References Cited

U.S. PATENT DOCUMENTS

| | | | | |
|---|---|---|---|---|
| 2,473,780 A | | 6/1949 | Benioff | 343/872 |
| 3,555,554 A | | 1/1971 | Kuo | 343/895 |
| 3,781,898 A | | 12/1973 | Holloway | 343/872 |
| 3,916,418 A | | 10/1975 | Erdmann et al. | 343/912 |
| 3,969,732 A | | 7/1976 | Holloway | 343/895 |
| 4,095,230 A | | 6/1978 | Salmond et al. | 343/729 |
| 4,187,509 A | * | 2/1980 | Weiner | 343/895 |
| 4,636,802 A | | 1/1987 | Middleton, Jr. | 343/895 |
| 4,661,821 A | | 4/1987 | Smith | 343/743 |
| 4,668,956 A | | 5/1987 | Mahnad | 343/789 |
| 4,797,684 A | | 1/1989 | Bernstein et al. | 343/895 |
| 4,945,363 A | | 7/1990 | Hoffman | 343/895 |
| 5,162,806 A | * | 11/1992 | Monser | 343/895 |
| 5,218,373 A | | 6/1993 | Heckaman et al. | 343/786 |
| 5,363,115 A | | 11/1994 | Lipkin et al. | 343/872 |
| 5,406,292 A | | 4/1995 | Schnetzer et al. | 343/700 MS |
| 5,621,422 A | | 4/1997 | Wang | 343/895 |
| 5,625,365 A | | 4/1997 | Tom et al. | 343/700 MS |
| 5,689,276 A | | 11/1997 | Uematsu et al. | 343/872 |
| 5,757,327 A | | 5/1998 | Yajima et al. | 343/713 |
| 5,764,192 A | | 6/1998 | Fowler et al. | 343/705 |
| 5,815,122 A | | 9/1998 | Nurnberger et al. | 343/767 |
| 5,836,005 A | | 11/1998 | Chang | 343/702 |
| 5,936,594 A | | 8/1999 | Yu et al. | 343/895 |
| 5,990,849 A | | 11/1999 | Salvail et al. | 343/895 |

* cited by examiner

*Primary Examiner*—Michael C. Wimer
(74) *Attorney, Agent, or Firm*—Schwartz & Weinrieb

(57) ABSTRACT

An antenna assembly has incorporated therein an antenna radome element or component which has a substantially cup-shaped configuration and which is provided with a plurality of concentrically disposed rib members upon the interior surface portion thereof. The rib members serve to not only reinforce the antenna radome element or component across the entire diametrical extent thereof, but in addition, the centermost rib member provides a recessed region or pocket for accommodating or housing terminal wires of the balun printed circuit board. In this manner, the terminal wires of the balun printed circuit board can be accommodated while the overall antenna assembly exhibits low profile characteristics in order to resolve operational spatial constraints or limitations.

20 Claims, 3 Drawing Sheets

LOW PROFILE ANTENNA RADOME ELEMENT WITH RIB REINFORCEMENTS

STATEMENT OF GOVERNMENT INTERESTS

The United States Government has a paid-up license in connection with the present invention and accordingly has the right in limited circumstances to require the patent owner to license others on reasonable terms as provided for by means of the terms of United States Government Contract Number N00019-97-C-0147 which was awarded by means of the United States Navy.

FIELD OF THE INVENTION

The present invention relates generally to antenna radome assemblies, and more particularly to a new and improved low profile antenna assembly wherein the antenna radome element or component is provided with a plurality of concentrically disposed rib members which serve not only to reinforce the antenna radome element or component but, in addition, provide the necessary spacing or clearance for accommodating or housing the terminal ends of the balun wires of the antenna assembly, which are electrically connected to the spiral circuits of the antenna assembly, in such a manner that the antenna assembly is able to in fact achieve its low profile characteristics and thereby resolve limited spatial requirements or constraints.

BACKGROUND OF THE INVENTION

Previously employed antenna assemblies have comprised antenna radome elements or components which have structurally embodied conical geometrical configurations in order to accommodate or house, for example, the terminal ends of the balun wires which are operatively associated with, and which are located at the axial center of, the spiral circuitry of the antenna assembly. Weapon replaceable assemblies employed upon or in conjunction with the E-2C Hawkeye 2000 antenna assembly or system, however, comprise different spatial limitations or constraints whereby all of the band antenna elements, that is, low, mid, and high band antenna elements, require low profile characteristics.

A need therefore exists in the art for a new and improved antenna assembly wherein the antenna assembly would have incorporated therein, for example, an antenna radome element or component such that the overall antenna assembly can exhibit low profile characteristics and thereby accommodate or resolve low profile spatial requirements or constraints while nevertheless accommodating or housing the terminal ends of the balun wires operatively associated with the spiral circuitry of the antenna assembly.

OBJECTS OF THE INVENTION

Accordingly, it is an object of the present invention to provide a new and improved antenna assembly.

Another object of the present invention is to provide a new and improved antenna assembly which effectively overcomes the various operational disadvantages or drawbacks characteristic of the prior art antenna assemblies.

An additional object of the present invention is to provide a new and improved antenna assembly which exhibits low profile characteristics in order to accommodate or resolve operational spatial requirements or constraints imposed upon the antenna assembly.

A further object of the present invention is to provide a new and improved antenna assembly which exhibits low profile characteristics in order to accommodate or resolve operational spatial requirements or constraints imposed upon the antenna assembly while nevertheless or simultaneously accommodating or housing the terminal ends of the balun wires operatively associated with the spiral circuitry of the antenna assembly.

SUMMARY OF THE INVENTION

The foregoing and other objectives are achieved in accordance with the teachings and principles of the present invention through the provision of a new and improved antenna assembly which comprises an antenna radome element or component which in effect has a substantially cup-shaped configuration. More particularly, the cup-shaped antenna radome element or component comprises a base member around the outer periphery of which there is integrally provided an annular upstanding or dependent wall, depending upon the particular perspective or viewpoint, and a plurality of concentrically disposed rib members integrally formed upon the rear or interior surface or face of the base member of the antenna radome element or component.

In this manner, the plurality of concentrically disposed or arranged rib members serve not only to effectively reinforce the antenna radome element or component, and more particularly, the base member thereof, throughout its entire diametrical extent, but in addition, the innermost annular rib member effectively defines a recessed space or pocket within which the terminal ends of the balun wires, operatively connected to the spiral circuitry of the antenna assembly, can be housed or accommodated. Accordingly, the new and improved antenna radome element or component of the antenna assembly of the present invention not only houses or accommodates the terminal end portions of the balun wires, but concomitantly therewith, the cup-shaped antenna radome element or component, having a relatively small or shallow depth dimension, enables the overall antenna assembly to simultaneously achieve its objective of low profile characteristics in order to resolve the operational spatial requirements or constraints imposed upon the antenna assembly.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 2:
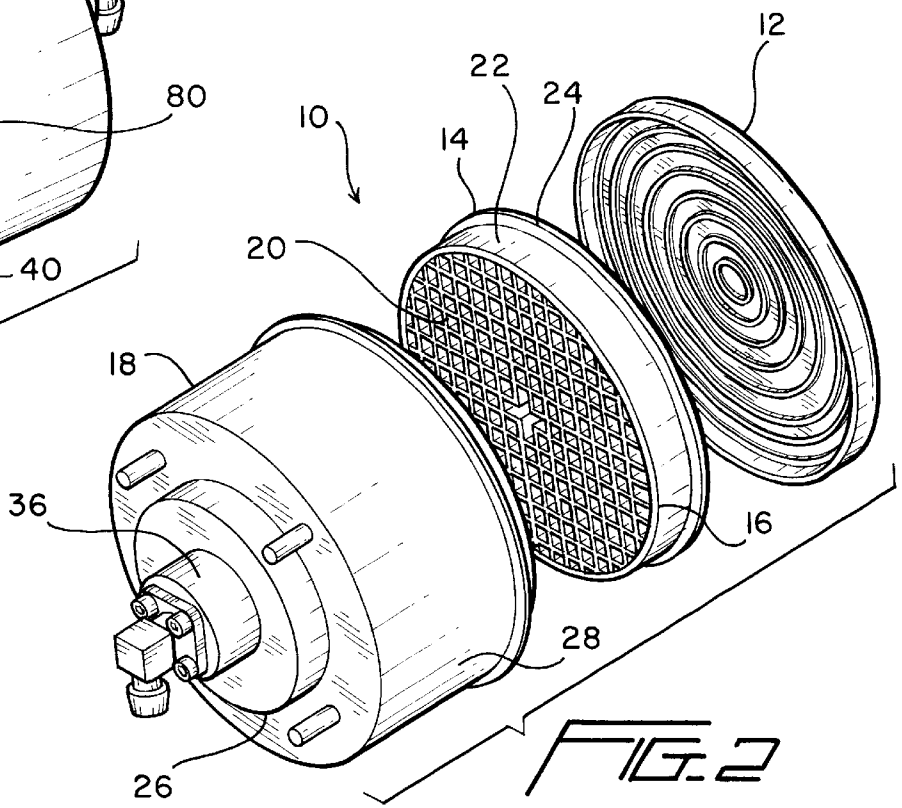
FIG. 2 is an exploded, rear perspective view of the new and improved antenna assembly illustrated in FIG. 1 and showing, in particular, the reinforcing rib members or structure provided upon the rear or interior face of the radome element or component of the antenna assembly.
Figure 1:
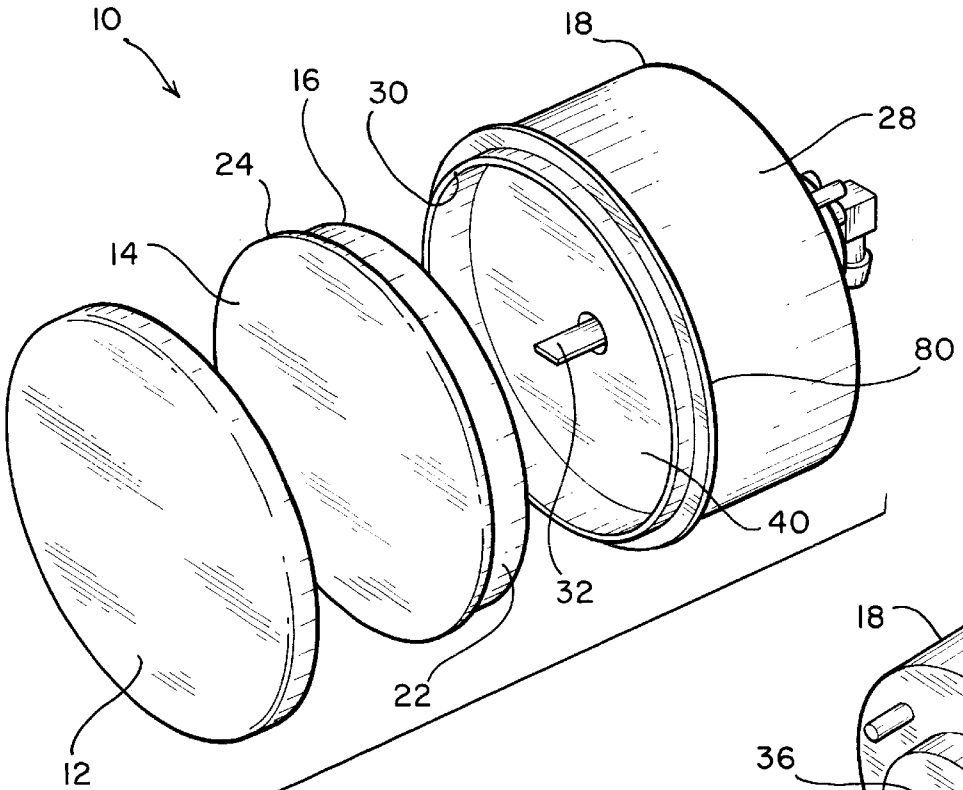
FIG. 1 is an exploded, front perspective view of the new and improved antenna assembly constructed in accordance with the principles and teachings of the present invention and showing the cooperative parts thereof.
Figure 3:
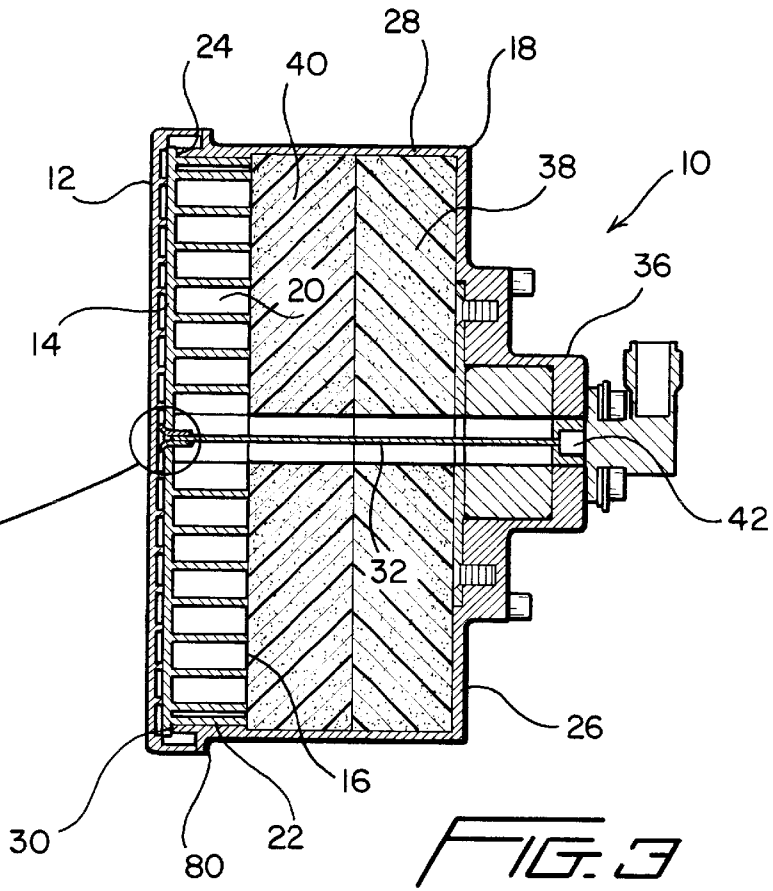
FIG. 3 is a longitudinal cross-sectional view of the new and improved antenna assembly illustrated in FIGS. 1 and 2 wherein the antenna assembly is illustrated in its assembled state.

Referring now to the drawings, and more particularly to FIGS. 1–3 thereof, the new and improved antenna assembly constructed in accordance with the principles and teachings of the present invention is disclosed and is generally indicated by the reference character 10. More particularly, the antenna assembly 10 is seen to comprise an antenna radome element or component 12, a spiral circuit element or member 14 upon which a pair of spiral circuits, arrays, or arrangements are disposed, a spiral circuit support member or component 16 which together with the spiral circuit element or member 14 comprises a spiral circuit support assembly, and a housing member or component 18. The spiral circuit element or member 14 comprises a printed circuit board assembly which has the configuration of a substantially flat disk and which may be fabricated from a suitable dielectric material, such as, for example, polytetrafluoro-ethylene (TEFLON®), upon which a pair of copper circuits, not shown, are provided, as is conventional. The spiral circuit element or member 14 is adapted to be mounted upon the front face of the spiral circuit support member or component 16 and is preferably bonded thereto by means of a suitable adhesive so as to form the aforenoted integral spiral circuit support assembly. As can best be seen from FIGS. 2 and 3, the spiral circuit support member or component 16 is seen to comprise a honeycomb core structure 20, and an annular reinforcing peripheral wall 22 is integrally secured around the honeycomb core structure 20.

In order to facilitate the mounting and bonding of the spiral circuit element or member 14 upon the front face of the spiral circuit support member or component 16, the front end of the spiral circuit support member or component 16, and more particularly, the front edge portion of the annular reinforcing peripheral wall 22, is provided with a radially outwardly extending or projecting flange portion 24 which, in addition to the front face or surface of the honeycomb core structure 20 of the spiral circuit support member or component 16, effectively defines a seat upon which the spiral circuit element or member 14 is able to be mounted and bonded. As may best be appreciated from FIG. 3, the housing member or component 18 comprises a substantially hollow structure which has a substantially cup-shaped configuration as defined by means of an open forward end, a base or rear end wall member 26, and a peripheral side wall member 28. It is seen that the inner diametrical dimension of the housing side wall 28 is just slightly larger than the outer diametrical dimension of the annular peripheral wall 22 of the spiral circuit support member or component 16, and in this manner, the annular peripheral wall portion 22, and the operatively associated honeycomb core structure 20, of the spiral circuit support member or component 16 is adapted, and is therefore able, to be mounted and seated internally within the forward open end of the housing 18. In conjunction with the internal disposition of the honeycomb core structure 20 and the annular peripheral wall portion 22 of the spiral circuit support member or component 16 within the housing 18, the rear side of the radially outwardly projecting flange portion 24 of the annular peripheral wall portion 22 of the spiral circuit support member or component 16 is seated upon the forward annular edge portion 30 of the side wall 28 of the housing 18 so as to ensure the proper and secure disposition and mounting of the spiral circuit support assembly upon or within the housing 18.

Figure 4:
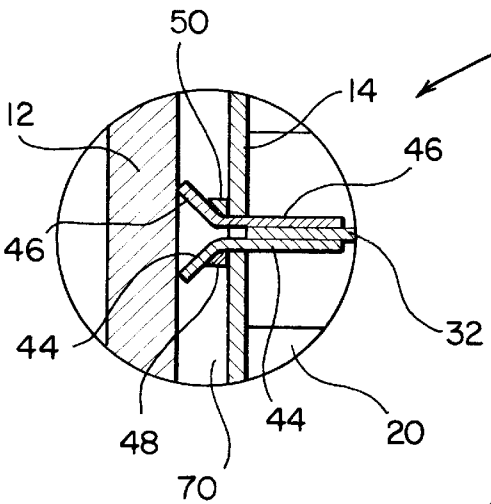
FIG. 4 is an enlarged view of the circled region A disclosed within FIG. 3 showing in detail the disposition and accommodation of the terminal end portions of the balun wires within the axially central pocket or recessed region of the antenna radome element or component.

With particular reference now being made to FIGS. 3 and 4, it is further seen that a balun assembly, comprising, for example, a balun printed circuit board 32, is disposed coaxially within the housing element or component 18, and that the balun printed circuit board 32 has a balun printed circuit wire coaxially disposed thereon. The rear end of the balun printed circuit board 32 is suitably secured within an axially protruding, rearwardly disposed stepped portion 36 of the housing element or component 18, and it is seen that a pair of frequency absorber foam members 38, 40 are disposed within the primary enlarged housing element or component 18. As best appreciated from FIG. 3, the balun printed circuit board 32 passes coaxially through the frequency absorber foam members 38, 40 such that the forward end of the balun printed circuit board 32 projects coaxially outwardly from the front surface of the forward one 40 of the pair of frequency absorber foam members 38, 40 as best seen in FIG. 1. In addition, it is also appreciated that when the integral spiral circuit support assembly, comprising the spiral circuit element or member 14 and the spiral circuit support member or component 16, is mounted or assembled within the housing element or component 18, as best seen or appreciated from FIG. 3, the forward end of the balun printed circuit board 32 will likewise be disposed coaxially within the honeycomb core structure 20 of the spiral circuit support member or component 16.

Still further, it is best appreciated from FIGS. 1 and 3 that the axial thickness or depth dimension of the pair of frequency absorber foam members 38, 40 is less than that of the primary enlarged housing element or component 18 such that the front surface of the forward one 40 of the pair of frequency absorber foam members 38, 40 is effectively disposed in a recessed mode set axially backward from the forward annular edge portion 30 of the side wall 28 of the housing 18. In this manner, the integral spiral circuit support assembly, comprising the spiral circuit element or member 14 and the spiral circuit support member or component 16, is able to be completely and properly mounted or accommodated within the housing element or component 18 with the radially outwardly projecting flange portion 24 of the annular peripheral wall portion 22 of the spiral circuit support member or component 16 being seated upon the forward annular edge portion 30 of the side wall 28 of the housing element or component 18 as has been noted hereinbefore. With the various components being so mounted or assembled, it will lastly be noted the rearward end of the balun printed circuit. board 32 is operatively connected to a coaxial connector 42 while the forward end of the balun printed circuit board 32 has terminal wires 44, 46 integrally connected thereto such that the terminal wires 44, 46 of the balun printed circuit board 32 project axially through the spiral circuit element or member 14 as best seen in FIG. 4. The terminal wires 44, 46 of the balun printed circuit board 32 are thus able to be electrically connected to the forward face of the spiral circuit element or member 14 by any suitable means, such as, for example, solder connections 48, 50, or the like, for electrical connection to the pair of spiral circuits formed upon the spiral circuit element or member 14.

Figure 5:
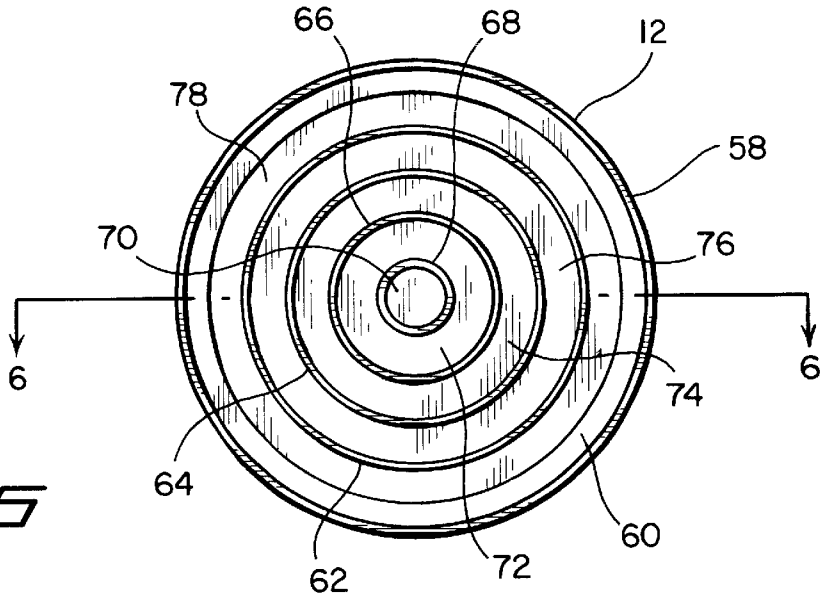
FIG. 5 is a rear or interior orthographic view of the new and improved antenna radome element or component constructed in accordance with the principles and teachings of the present invention.

It has also been noted hereinbefore that the terminal wires 44, 46 of the balun printed circuit board 32, which are operatively associated with the spiral circuitry disposed upon the spiral circuit element or component of the antenna assembly 10, must be accommodated or housed within the antenna radome element or component 12 while the antenna radome element or component 12, and therefore the entire antenna assembly 10, must also or simultaneously exhibit low profile characteristics in order to accommodate or resolve low profile operational spatial requirements or constraints. In accordance with the principles and teachings of the present invention, the antenna radome element or component 12 of the present invention is provided with unique structure which satisfies the aforenoted requirements or operational needs. More particularly, as may best be appreciated from FIGS. 5 and 6, the antenna radome element or component 12 is seen to have a substantially cup-shaped configuration as defined by means of a forwardly disposed wall member 52 from which a dependent or rearwardly disposed or facing annular or peripheral side wall member 54 projects. It is to be appreciated further that in accordance with the principles and teachings of the present invention, and in order to achieve the low profile characteristics of the antenna radome element or component 12, the entire forwardly disposed wall member 52 is disposed within a plane which is perpendicular or transverse to the central axis 56 of radome element or component 12, and in a similar manner, the peripheral or annular wall member 54 is disposed perpendicular to the plane of the forwardly disposed wall member 52.

Figure 6:
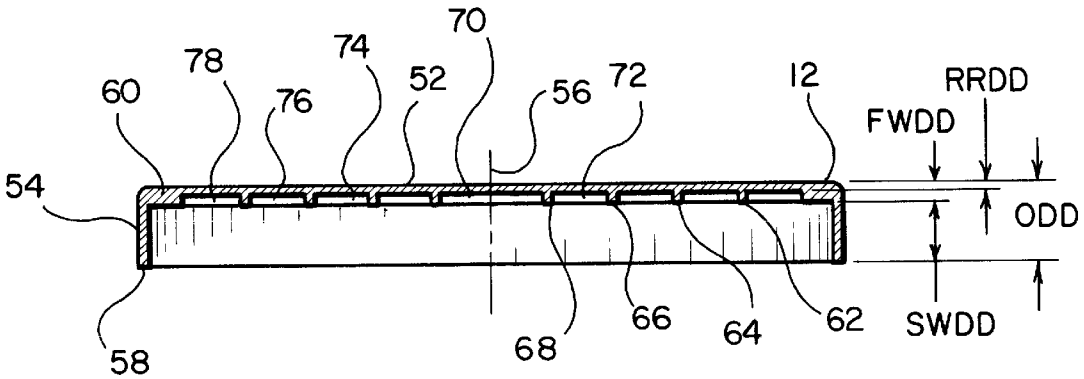
FIG. 6 is a cross-sectional view of the new and improved antenna radome element or component as illustrated in FIG. 5 and as taken along the lines 6—6 of FIG. 5.

With respect to the specific dimensions of the antenna radome element or component 12, and in order to in fact achieve the low profile characteristics thereof, the entire or overall depth dimension ODD of the radome element or component, as measured from the outer or forward face of the wall member 52 to the lower peripheral or annular edge portion 58 of the annular or peripheral wall member 54, and as seen in FIG. 6, is 0.201 inches. The depth dimension FWDD of the forwardly disposed wall member 52 per se is seen to be 0.037 inches, however, it is noted that such thickness or depth dimension only occurs within the radially outermost region 60 of the wall member 52. The reason for this is that in accordance with the principles and teachings of the present invention, the remaining interior surface portion of the wall member 52 is provided with a plurality of concentrically disposed downwardly or rearwardly disposed or facing rib members 62, 64, 66, 68.

Each one of the rib members 62–68 has a depth dimension of 0.025 inches whereby the thickness or depth dimension RRDD of the wall member 52 within the ribbed regions thereof is 0.012 inches, and each one of the rib members 62–68 has a radial thickness or width dimension of 0.015 inches. It is additionally noted that the diametrical extent of the first innermost rib member 68 is approximately 0.28 inches, the diametrical extent of the second rib member, that is, rib member 66 which is disposed adjacent to the first innermost rib member 68, is approximately 0.61 inches, the diametrical extent of the third rib member, that is, rib member 64 which is disposed adjacent to the second rib member 66, is approximately 0.94 inches, and the diametrical extent of the fourth outermost rib member 62 is approximately 1.27 inches. It is further noted that the inner diametrical extent of the radially outermost wall region 60 is 1.60 inches, and thus, it can be appreciated that the radial spacing between respective adjacent rib members 62–68, as well as between the outermost rib member 62 and the outermost wall region 60 is approximately 0.165 inches. As one might readily appreciate, the plurality of concentrically disposed rib members 62–68 serve not only to reinforce the antenna radome element or component 12 throughout its diametrical extent, particularly when assembled upon and affixed to the spiral circuit element or component 14 as will be discussed further hereinafter, but in addition, and critically important for the purposes and objectives of the present invention, the plurality of concentrically disposed rib members 62–68 define circular and annular recessed regions or pockets 70, 72, 74, 76, 78 within the first innermost rib member 68, between successively adjacent rib members 68 and 66, 66 and 64, and 64 and 62, and between outermost rib member 62 and wall region 60, respectively.

Of the aforenoted recessed regions or pockets 70–78, the innermost or axially central region or pocket 70 is critically the most important because such recessed region or pocket 70, as defined by means of the central rib member 68, serves to accommodate or house the terminal wires 44, 46 of the balun printed circuit board wire 32 as best seen in FIG. 4. Viewed alternatively, all of the rib members 62–68, and specifically the innermost rib member 68, cooperate with the spiral circuit element or component 14 to define clearance spaces, or more specifically, the recessed regions or pockets 70–78, between the end wall member 52 and the spiral circuit element or component 14 when the various components of the antenna assembly 10 are assembled together as seen in FIG. 3. Accordingly, the primary objectives and purposes of the present invention have been able to be achieved, that is, the provision of an antenna radome element or component 12 which is not only capable of housing or accommodating the terminal wires 44, 46 of the balun printed circuit board wire 32, but in addition, the provision of an antenna radome element or component 12 has also been able to achieve the same while providing the antenna radome element or component 12, and therefore the entire antenna assembly 10, with low profile characteristics so as to resolve operational spatial limitations or restrictions. When the antenna radome element or component 12 is to be fixedly incorporated within the antenna assembly 10 as seen in FIG. 3, the interior surface of the wall region 60, as well as the free or lower edge portions of the rib members 62–68 are bonded to the outer surface portion of the spiral circuit element or member 14.

It is additionally noted that the housing member 18 is also provided with a radially outwardly projecting annular flange member 80 at an axial position which is adjacent to, but axially set back from, the forward annular edge portion 30 of the side wall 28 of the housing 18. The internal side wall depth dimension SWDD of the annular or peripheral side wall 54 of the antenna radome element 12 is 0.164 inches and is such that when the antenna radome element 12 is in fact bonded to and upon the spiral circuit element or member 14, and when the spiral circuit support assembly, comprising the spiral circuit element or member 14 and the spiral circuit support member or component 16, is in turn mounted within housing 18, the lower annular or peripheral edge portion 58 of the antenna radome element side wall 54 will be seated upon the annular flange portion or member 80 of the housing side wall 28. In order to hermetically seal the antenna assembly 10, a suitable sealant, such as, for example, a urethane composition or other adhesive, is interposed between the respective abutting surfaces of the spiral circuit support assembly and the housing 18, that is, between the inner peripheral surface portion of the antenna radome element 12 and the outer peripheral surface portion of the housing side wall 28 within the vicinity of the housing flanged portion 80, as well between the inner peripheral surface portion of the housing side wall 28 and the outer peripheral surface portion of the spiral circuit support member wall portion 22.

Thus, it may be seen that in accordance with the principles and teachings of the present invention, there has been provided a new and improved antenna assembly which comprises a housing member and which has incorporated within the assembly a new and improved antenna radome element or component. The new and improved antenna radome element or component has a substantially cup-shaped configuration and is provided with a plurality of rib members upon the interior surface portion thereof. The rib members serve to not only provide reinforcement for the antenna radome element or component throughout the diametrical extent thereof, but in addition, and most importantly for the purposes and objectives of the present invention, the centermost rib member defines a recessed region or pocket, which effectively cooperates with the spiral circuit element or component to define a clearance space when the radome element or component is mounted upon the housing member of the antenna assembly, so as to provide the necessary clearance for housing or accommodating the terminal wires of the balun printed circuit board. Consequently, the terminal wires of the balun printed circuit board wire can be properly accommodated or housed while the overall antenna assembly exhibits low profile characteristics so as to resolve operational spatial restrictions, constraints, limitations, or the like.

Obviously, many variations and modifications of the present invention are possible in light of the above teachings. It is therefore to be understood that within the scope of the appended claims, the present invention may be practiced otherwise than as specifically described herein.

WHAT is claimed as new and desired to be protected by Letters Patent of the United States of America is:

1. An antenna radome member for use within an antenna assembly, comprising:

an antenna radome element comprising a radial extent around an axis and a substantially planar end wall extending transversely with respect to said axis; and a plurality of substantially circular, concentrically arranged rib members formed upon an interior surface portion of said substantially planar end wall of said antenna radome element and extending axially away from said substantially planar end wall of said antenna radome element for reinforcing said substantially planar end wall of said antenna radome element throughout said radial extent thereof and for engaging a spiral circuit member of the antenna assembly so as to define with the spiral circuit member an axially central clearance space for accommodating terminal wires of a balun printed circuit board.

2. The antenna radome member as set forth in claim 1, wherein:

said substantially planar end wall of said antenna radome element has a substantially circular configuration and a predetermined diametrical extent; and said plurality of substantially circular, concentrically disposed rib members are radially spaced from each other throughout said diametrical extent of said substantially planar end wall of said antenna radome element for reinforcing said substantially planar end wall of said antenna radome element throughout said diametrical extent thereof.

3. The antenna radome member as set forth in claim 1, wherein:

said plurality of substantially circular rib members comprises a circular rib member disposed at an axially central position upon said interior surface portion of said substantially planar end wall so as to accommodate the terminal wires of the balun printed circuit board which is disposed coaxially within the antenna assembly.

4. The antenna radome member as set forth in claim 1, wherein:

said antenna radome element has a substantially cup-shaped configuration defined by means of said substantially planar end wall extending transversely with respect to said axis, and an axially extending peripheral side wall integral with said substantially planar end wall and disposed perpendicular to said substantially planar end wall.

5. The antenna radome member as set forth in claim 4, wherein:

the overall depth dimension of said antenna radome element, as measured from an external surface portion of said substantially planar end wall to a free edge portion of said peripheral side wall, is approximately 0.2 inches, whereby said antenna radome element exhibits low profile characteristics such that operational spatial constraints of the antenna assembly are effectively resolved.

6. An antenna radome member for use within an antenna assembly, comprising: an antenna radome element comprising an axis and a substantially planar end wall extending transversely with respect to said axis so as to define a predetermined diametrical extent; and a plurality of substantially circular, concentrically arranged rib members formed upon an interior surface portion of said substantially planar end wall of said antenna radome element and extending axially away from said substantially planar end wall of said antenna radome element for reinforcing said substantially planar end wall of said antenna radome element throughout said diametrical extent thereof and for defining an axially central recessed space for accommodating terminal wires of a balun printed circuit board of the antenna assembly.

7. The antenna radome member as set forth in claim 6, wherein:

said substantially planar end wall of said antenna radome element has a substantially circular configuration; and said plurality of concentrically disposed rib members are radially spaced from each other throughout said diametrical extent of said substantially planar end wall of said antenna radome element.

8. The antenna radome member as set forth in claim 6, wherein:

said plurality of substantially circular rib members comprises a circular rib member disposed at an axially central position upon said interior surface portion of said substantially planar end wall of said antenna radome element so as to accommodate the terminal wires of the balun printed circuit board which is disposed coaxially within the antenna assembly.

9. The antenna radome member as set forth in claim 6, wherein:

said antenna radome element has a substantially cup-shaped configuration defined by means of said substantially planar end wall extending transversely with respect to said axis, and an axially extending peripheral side wall integral with said substantially planar end wall and disposed perpendicular to said substantially planar end wall.

10. The antenna radome member as set forth in claim 9, wherein:

the overall depth dimension of said antenna radome element, as measured from an external surface portion of said substantially planar end wall to a free edge portion of said peripheral side wall, is approximately 0.2 inches, whereby said antenna radome element exhibits low profile characteristics such that operational spatial constraints of the antenna assembly are effectively resolved.

11. An antenna assembly, comprising:

a housing;

a spiral circuit member having a pair of spiral circuits disposed thereon;

a balun printed circuit board disposed within said housing wherein terminal wires of said balun printed circuit board are electrically connected to said pair of spiral circuits disposed upon said spiral circuit member;

an antenna radome element comprising an axis and a substantially planar end wall extending transversely with respect to said axis so as to define a predetermined diametrical extent; and a plurality of substantially circular, concentrically arranged rib members formed upon an interior surface portion of said substantially planar end wall of said antenna radome element and extending axially away from said substantially planar end wall of said antenna radome element for reinforcing said substantially planar end wall of said antenna radome element throughout said diametrical extent thereof and for engaging said spiral circuit member of said antenna assembly so as to define with said spiral circuit member an axially central clearance space for accommodating said terminal wires of said balun printed circuit board.

12. The antenna assembly as set forth in claim 11, wherein:

said substantially planar end wall of said antenna radome element has a substantially circular configuration; and said plurality of concentrically disposed rib members are radially spaced from each other throughout said diametrical extent of said substantially planar end wall of said antenna radome element.

13. The antenna assembly as set forth in claim 11, wherein:

said substantially circular rib members comprises a circular rib member disposed at an axially central position upon said interior surface portion of said substantially planar end wall of said antenna radome element so as to accommodate said terminal wires of said balun printed circuit board which is disposed coaxially within said antenna assembly.

14. The antenna assembly as set forth in claim 11, wherein:

said antenna radome element has a substantially cup-shaped configuration defined by means of said substantially planar end wall extending transversely with respect to said axis, and an axially extending peripheral side wall integral with said substantially planar end wall and disposed perpendicular to said substantially planar end wall.

15. The antenna assembly as set forth in claim 14, wherein:

the overall depth dimension of said antenna radome element, as measured from an external surface portion of said substantially planar end wall to a free edge portion of said peripheral side wall, is approximately 0.2 inches, whereby said antenna radome element exhibits low profile characteristics such that operational spatial constraints of said antenna assembly are effectively resolved.

16. The antenna assembly as set forth in claim 14, wherein:

said axially extending peripheral side wall of said antenna radome element is bonded to an exterior side wall portion of said housing so as to hermetically seal said antenna assembly.

17. The antenna assembly as set forth in claim 11, wherein:

a pair of frequency absorbers are disposed within said housing; and said balun printed circuit board passes coaxially through said pair of frequency absorbers.

18. The antenna assembly as set forth in claim 11, wherein:

a spiral circuit support member, upon which spiral circuit member is fixedly disposed, is disposed within said housing; and said balun printed circuit board passes coaxially through said spiral circuit support member.

19. The antenna assembly as set forth in claim 18, wherein:

said spiral circuit support member comprises a honeycomb core structure.

20. The antenna assembly as set forth in claim 11, wherein:

a pair of frequency absorbers are disposed within said housing; and a spiral circuit support member, upon which spiral circuit member is fixedly disposed, is disposed within said housing so as to be interposed between said pair of frequency absorbers and said substantially planar end wall of said antenna radome element.

* * * * *